US009216890B1

(12) United States Patent
Daniels et al.

(10) Patent No.: US 9,216,890 B1
(45) Date of Patent: Dec. 22, 2015

(54) VERTICAL STORAGE UNIT FOR DISPENSING A FUEL ADDITIVE

(71) Applicant: Titan Chemical Transfer Solutions, LLC, Greenville, SC (US)

(72) Inventors: Mark Daniels, Greenville, SC (US); Henrik Rokkjaer, Fernley, NV (US)

(73) Assignee: Titan Chemical Transfer Solutions, LLC, Greenville, SC (US)

( * ) Notice: Subject to any disclaimer, the term of this patent is extended or adjusted under 35 U.S.C. 154(b) by 1 day.

(21) Appl. No.: 14/304,558

(22) Filed: Jun. 13, 2014

(51) Int. Cl.

| | |
|---|---|
| ***B67D 7/14*** | (2010.01) |
| ***B67D 7/04*** | (2010.01) |
| ***F17D 3/01*** | (2006.01) |
| *B67D 7/02* | (2010.01) |

(52) U.S. Cl.
CPC .. *B67D 7/04* (2013.01); *F17D 3/01* (2013.01); *B67D 7/02* (2013.01)

(58) Field of Classification Search
CPC ..... A01K 5/0225; A47L 7/0023; B01F 15/00863; B01F 15/0445; B05C 11/101; B67D 3/0003; B67D 3/0032; B67D 3/0093; B67D 7/02; B67D 7/04; F17D 3/01; F17D 3/14
See application file for complete search history.

(56) References Cited

U.S. PATENT DOCUMENTS

| | | | | |
|---|---|---|---|---|
| 4,339,307 | A * | 7/1982 | Ellis, Jr. | 202/176 |
| 5,029,602 | A * | 7/1991 | McKinney et al. | 137/209 |
| 6,290,819 | B1 * | 9/2001 | Land | 202/83 |
| 2008/0179344 | A1 * | 7/2008 | Michaels et al. | 222/20 |
| 2010/0025407 | A1 * | 2/2010 | Benson | 220/564 |

* cited by examiner

*Primary Examiner* — Frederick C Nicolas
*Assistant Examiner* — Bob Zadeh
(74) *Attorney, Agent, or Firm* — McNair Law Firm, P.A.; Douglas W. Kim

(57) ABSTRACT

This invention is directed to a vertical fluid storage system that has a lower container for containing fluid that includes a lower fill port defined in the top of the lower container. A routing hose routes fluid from the lower fill port to an upper container disposed above the lower container. The upper container includes an upper outlet connected to a gravity hose wherein the gravity hose is connected to a gravity port to direct fluid from the upper container to the lower container. An intake valve attached to the lower container and closes to prevent fluid from flowing from the upper container to the lower container when the amount of fluid in the lower container reaches a certain volume.

20 Claims, 2 Drawing Sheets

VERTICAL STORAGE UNIT FOR DISPENSING A FUEL ADDITIVE

FIELD OF THE INVENTION

This invention is directed to a vertical storage and dispenser unit and more specifically to a vertical storage and dispensing unit for DEF.

BACKGROUND OF THE INVENTION

In the United States, the Clean Air Act established emission standards to regulate several pollutants that include nitrogen oxide (NOx), particulate matter (PM), carbon monoxide (CO), and hydrocarbons. One challenge for engine operators, under the Clean Air Act, is to limit the NOx emissions to comply with the ammonium g/bhp-hr standards. For operators of diesel engines, this standard proved to be problematic. One solution is known as the Selective Catalytic Reaction (SCR) technology.

SCR is an "after treatment" technology to reduce the NOx in the exhaust emissions of a diesel engine. The SCR relies upon an operating fluid called Diesel Exhaust Fluid or DEF. DEF is injected into the exhaust pipe in front of a SCR catalyst and downstream of the engine. The heat of the engine exhaust causes the DEF to decompose into ammonia. The NOx reacts with the ammonia in the catalyst and the Nox molecules are converted into $N_2$ and $H_2O$.

DEF is a solution that is about 32% of a high-priority area in deionized water THE DEF is stored as a separate DEF tank, which is connected to the DEF injector. The average consumption of DEF is about 3% per gallon of diesel fuel so that the DEF tank is significantly smaller than the fuel tank.

Historically, operators would purchase DEF in small portable containers that would only hold a few gallons and use these portable containers to fill the DEF tanks associated with the diesel engine. Since about 3 gallons of DEF would be needed for about 100 gallons of fuel plastic containers from 35 to 15,000 gallons, over time, bulk containers began to appear and were located on-site of the operator so that the DEF tank was filled from a bulk dispenser.

However, storage of DEF began to exhibit problems due to the nature of DEF. For example, DEF freezes around 12° F. and will expand about 7%. As a result, the container expands and there is damage to the hose and pump. Additives should not be added to DEF to reduce the freezing point, as such additives can harm the SRC catalyst.

As DEF use increased, driven by the Clean Air Act, DEF dispensers were increasingly appearing at fuel islands so that DEF tanks could be refilled while filling diesel fuel tanks. However, given the limited space available at a fuel island, the tanks that would fit on the island had limited capacity. One solution was to stack containers or totes on top of one another so that the containers were arranged vertically to increase the storage capacity while maintaining the same footprint.

This arrangement was considered desirable given the vertical space between the ground and cover of a fuel island. The space could accommodate 18 wheel trucks. Unfortunately when the container on top needs to be filled, the fill opening has to be much higher than the operator can reach. As a result, a ladder is needed to fill the top container. Having an operator stand on a ladder in a fuel island, while attempting to use a nozzle and hose to fill the top container, is not desirable.

Another often overlooked disadvantage in the stacked configuration is that when a hose from the top container is disconnected after filling or dispensing, the hose then becomes positioned lower than the top container and fluid in the hose leaks out on to the ground or other undesirable location. Simply stacking two containers on top of one another is not the solution.

Another disadvantage with conventional storage containers is they are typically round to increase strength and prevent bulging. However, round containers typically do not properly fit on a fuel island and do not maximize the foot print for storage on a fuel island. Making a container with flat sides is advantageous for the fuel island, but the flat sides tend to bulge when a certain volume is reached so that the container extends over the fuel island. Attempt to strengthen the walls of a flat sided container lead to increased costs. Given the pressure of a full container, making one that is in excess of 10 feet in height results in a reinforced container that is not economical. It would be desirable to have a vertical shape system configured for a fuel island that could be filled completely from an operator at ground level.

Another difficulty created by the Clean Air Act is to have diesel engines that are used in remote areas to have DEF sources that are portable. For example, farm equipment, construction equipment, diesel engines, and the like. Many of these diesel engines operate in locations that are remote from fuel sources and therefore have high capacity fuel tanks. It would be advantageous to have a vertically stackable DEF source that can increase storage capability without increasing the footprint of the storage unit.

Additionally, portable DEF supplies also need to be refilled and it would be advantageous to be able to use the same hose, pump, and nozzle to fill the portable DEF source from a bulk container that is used to fill the DEF tank of a diesel engine from a DEF portable supply. It would also be advantageous to be able to refill the bulk container from a mobile DEF supply using the same pump configuration.

Therefore, it is an object of the present invention to provide for a vertical storage container that can be filled by an operator standing on the ground.

It is also an object of this invention to provide vertically stacked totes for storage of DEF.

It is also an object of the present invention to provide for a dispensing/fill assembly that can be used to fill the DEF source from a mobile storage container without duplicating the pump and hoses.

SUMMARY OF THE INVENTION

The objectives of the present invention are accomplished by providing a vertical fluid storage system comprising: a lower container for containing fluid; a lower fill port defined in the top of the lower container; a routing hose having a first section attached between the fill port and a swivel and a second portion attached between the swivel and a top fill hose; an upper container disposed above the lower container having a top fill port on the top of the upper container wherein the fill hose is connected; an upper outlet included in the upper container connected to a gravity hose wherein the gravity hose is connected to a gravity port; and, an intake valve attached to the lower container wherein the intake valve closes to prevent fluid from flowing from the upper container to the lower container when the amount of fluid in the lower container reaches a certain volume.

The intake valve can be a float valve in one embodiment. A dispensing port can be included in the lower container; a pump can be attached to the dispensing port by a first dispensing hose attached between the dispensing port and the pump; and, a nozzle can be attached to the pump by a second dispensing hose attached between the nozzle and the pump. The pump and first dispensing hose is removably attached to the lower container.

A spacer can be disposed between the lower and upper containers defining an access area.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE INVENTION

Figure 1:
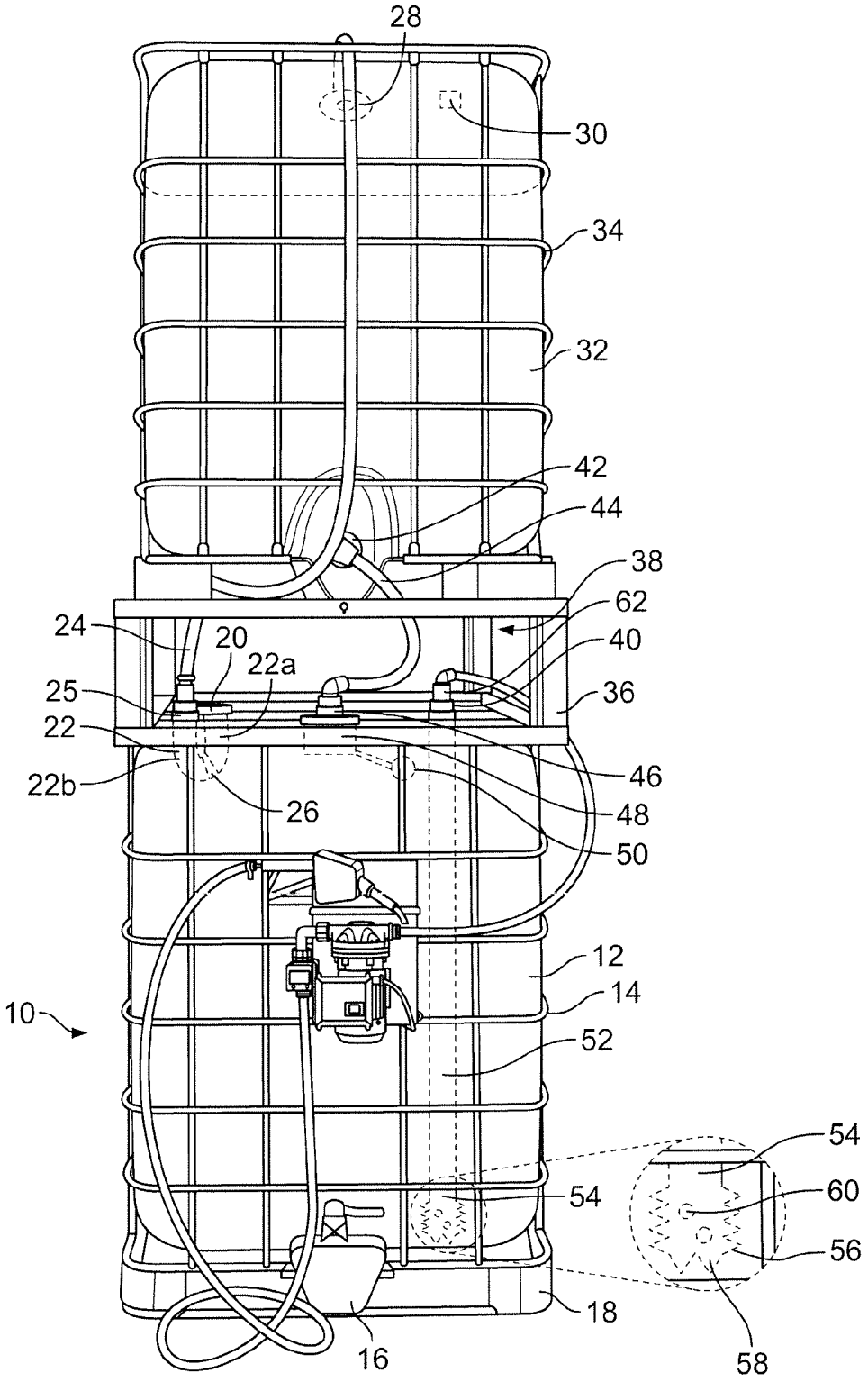
FIGS. 1 and 2 are perspective views of various components of the invention.

Referring to FIG. 1, a lower storage assembly 10 is shown having a lower container 12 and a lower cage 14 that receives the lower container. A lower drain assembly 16 is attached to the lower container. The lower drain assembly can include an outlet, valve and handle. A lower base 18 can be included with the lower storage assembly to support the lower storage assembly and to provide sufficient clearance for the lower drain assembly. A lower fill port 20 receives a nozzle or other apparatus to receive fluid from an external source such as another bulk container, mobile source or portable source. When fluid is received by the lower fill valve, the fluid is directed by a routing hose 22 to top fill hose 24. The top fill hose can be connected to a top fill hose port 25. The routing hose 22 includes a swivel 26 allowing the first section 22*a* of the routing hose to rotate about the second section 22*b* of the routing hose. When installing or otherwise manipulating the routing hose, otherwise, the swivel allows the first section to be secured to the lower fill port by a threaded assembly so that when the first section is rotateably attached to the lower fill port, the hose does not kink or otherwise deform undesirably. Further, since the first section rotates independently of the second section, threading the first section on the lower fill port would not disconnect the second section from the top fill hose.

The top fill hose is attached to the top fill inlet 28 of the upper container 32. The top fill inlet can include a pressure relief assembly to prevent overfilling or over pressurizing. In one embodiment, a pressure relief valve 30 is included in the top of the upper container. When fluid is received by the lower fill valve, the fluid is under pressure so that the fluid is forced into the top fill hose and into the top container. The fluid then is gravity fed into the upper outlet 42 and into the attached gravity hose 44 so that the fluid is delivered into the lower container through gravity port 46. The gravity port can include a fill valve or intake valve 48 that shuts off the gravity port once the lower container reaches a predetermined volume. In one embodiment, the fill valve is a float valve 50.

In operation, fluid is delivered to the lower fill port, travels through the routing hose into the top fill hose, fills the upper container, is gravity fed into the upper outlet and into the gravity hose and into the lower container. When the lower container is at a predetermined level, such as nearly full, the fill valve closes and the fluid can no longer flow through the gravity hose. Therefore, the upper container begins to fill. When the upper container is full, pressure in the routing hose increases which can be detected by a fill nozzle and the nozzle can automatically shut off. In one embodiment, the containers are transparent or semi-transparent allowing the operator to see the fluid level in the containers.

An upper cage 34 can be included to receive the upper container. The upper container and the lower container can be carried by a spacer 36 that is disposed between the two containers. The spacer defines an access area 38 allowing access to the lower fill valve, lower outlet 40 that can be connected to dispensing valve 62 and other components of the invention.

The lower outlet can include a snorkel 52 so that fluid can be removed from the lower container. The distal end 54 of the snorkel can include a resilient section 56 allowing the snorkel to contact the bottom of the container without permanent deformation. Extensions 58 can be included in the distal end so that if the distal end of the snorkel contacts the bottom of the container, fluid can still flow between the extensions. Opening 60 can be included in the distal end to allow fluid to flow into the snorkel even when the snorkel is contacting the bottom of the container.

Figure 2:
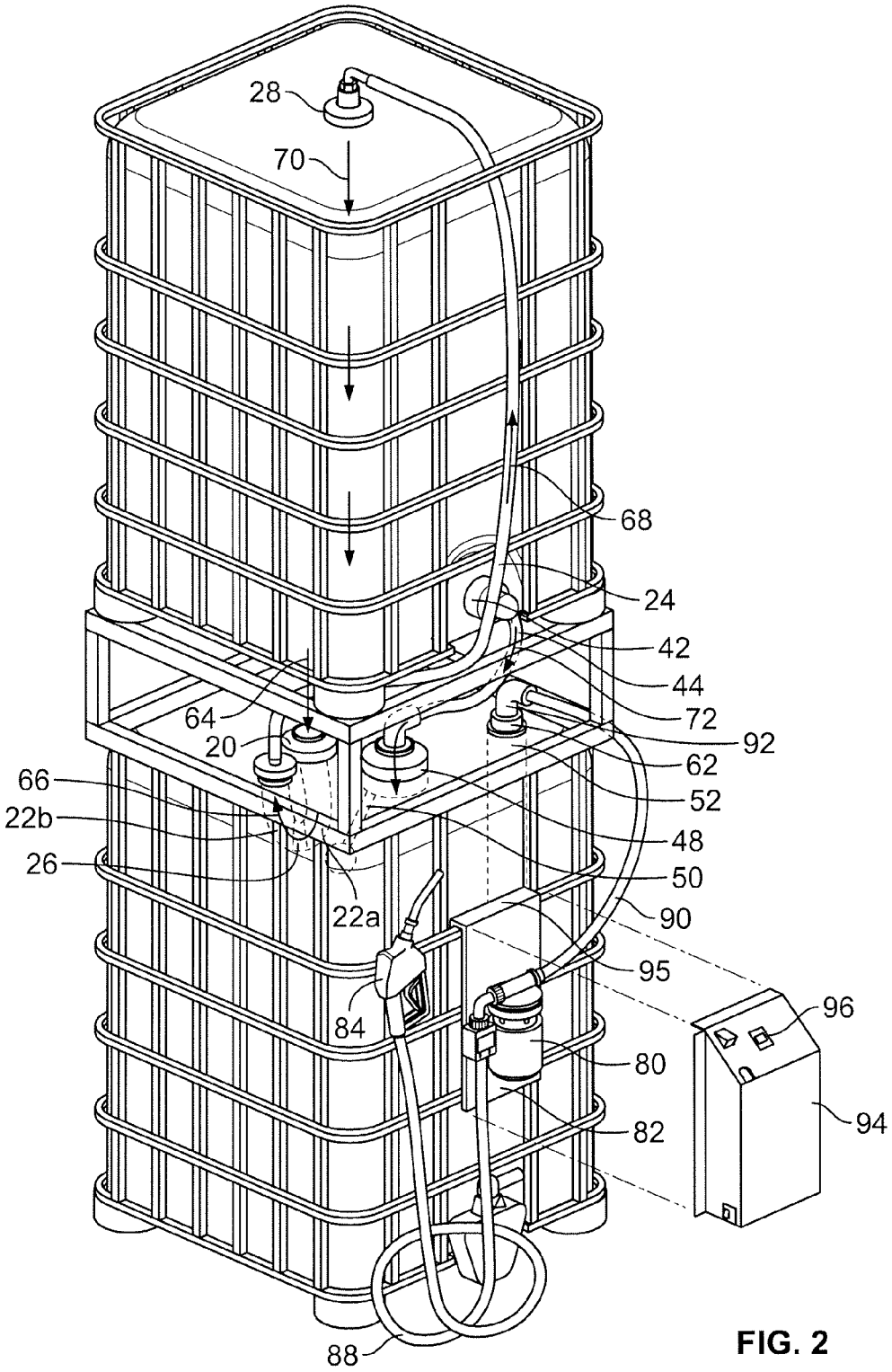

Referring to FIG. 2, the fluid enters the lower container at path 64 and travels through routing hose 22 along path 66. The fluid travels upward through the top fill hose along path 68 and into the top fill inlet. The fluid enters the upper container at 70 and drops to the bottom of the container. The fluid enters the upper outlet and travels through gravity hose 44 along path 72. The fluid then encounters the fill valve and if the fill valve is closed, the fluid will accumulate in the upper container. If the fill valve is open, the fluid will accumulate in the lower container.

In one embodiment, a pump 80 can be attached to a pump plate 82 so that the pump and pump plate are removably attached to the lower cage. Nozzle 84 is connected to the pump to dispense fluid from the container. A first dispensing hose 88 connects the nozzle to the pump. In one embodiment, the nozzle is a DEF nozzle. A second dispensing hose 90 is connected between the pump and a dispensing coupling 92. The pump can be powered by an external power source connected to the pump by the power cables and power cable clamps. In one embodiment, the pump can be contained within a pump housing that can be attached to the pump plate. The pump plate can include a pump bracket 95 that can be used to hang the pump plate on the lower cage. The pump housing 94 can include a nozzle carrier 96 for supporting the nozzle when the nozzle is not in use.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to," or other like phrases in some instances shall not be read to mean that the narrower case is intended or required in instances where such broadening phrases may be absent.

What is claimed is:

1. A vertical fluid storage system comprising:

a lower container for containing fluid;

a lower fill port defined in the top of the lower container;

a routing hose having a first section attached between the lower fill port and a swivel and a second portion attached between the swivel and a top fill hose;

an upper container disposed above the lower container having a top fill port on the top of the upper container wherein the top fill hose is connected; and, an upper outlet included in the upper container connected to a gravity hose wherein the gravity hose is connected to a gravity port; and, an intake valve attached to the lower container wherein the intake valve closes to prevent fluid from flowing from the upper container to the lower container when the amount of fluid in the lower container reaches a certain volume.

2. The system of 1 wherein the intake valve is a float valve.

3. The system of claim 1 including:

a dispensing port included in the lower container;

a pump attached to the dispensing port by a second dispensing hose attached between the dispensing port and the pump; and, a nozzle attached to the pump by a first dispensing hose attached between the nozzle and the pump.

4. The system of claim 3 wherein the second dispensing hose is removably attached to the lower container.

5. The system of claim 1 including a spacer disposed between the lower and upper containers defining an access area.

6. A vertical stage fluid storage system comprising:

a lower container for containing fluid;

a lower fill port defined in the top of the lower container;

a top fill hose carried by the lower fill port and a top fill inlet included on the top of an upper container; and, an upper outlet included at the bottom of the upper container connected to a gravity hose wherein the gravity hose is connected to an intake valve attached to the lower container wherein the intake valve closes to prevent fluid from flowing from the upper container to the lower container when the amount of fluid in the lower container reaches a certain volume.

7. The system of claim 6 including a swivel attached to a routing hose and connected between the lower fill port and the top fill hose.

8. The system of claim 6 wherein:

the top fill hose includes a portion disposed internal to the lower container; and, a swivel carried by the portion of the top fill hose disposed internal to the lower container.

9. The system of claim 6 wherein the intake valve is a float valve.

10. The system of claim 6 including a pressure relief valve included in the upper container.

11. The system of claim 6 including a lower cage for containing the lower container and an upper cage for containing the upper container.

12. The system of claim 11 including a spacer disposed between the lower and upper cage defining an access area between the lower container and the upper container allowing a nozzle to be positioned between the lower and upper container.

13. The system of claim 11 wherein a pump is removable carried by the lower cage and in fluid communication with the fluid in the lower container to dispense fluid out of the lower container.

14. The system of claim 13 where in the pump is attached to a pump plate that is removably attached to the lower cage.

15. The system of claim 13 including a pump housing containing the pump and including a nozzle holder.

16. The system of claim 13 including a power connection to connect the pump to an eternal power source.

17. A vertical stage fluid storage system comprising:

a container cage containing a lower and upper container where the lower and upper container are vertically spaced apart;

a lower fill port included in the lower container;

a top fill hose port included in the lower container;

a routing hose connected to the lower fill port and the top fill hose port;

an external top fill hose connected to the top fill hose port and the upper container;

a gravity hose connected between the upper container and an intake valve of the lower container allowing fluid to flow from the upper container to the lower container wherein the intake valve closes to prevent fluid from flowing from the upper container to the lower container when the amount of fluid in the lower container reaches a certain volume.

18. The system of claim 17 including a swivel carried by the routing hose.

19. The system of claim 17 wherein the intake valve is a float valve.

20. The system of claim 17 including a pressure release valve included in the upper container.

* * * * *